US010567874B2

(12) United States Patent
Tsai

(10) Patent No.: US 10,567,874 B2
(45) Date of Patent: Feb. 18, 2020

(54) SIGNAL PROCESSING DEVICE AND SIGNAL PROCESSING METHOD

(71) Applicant: Realtek Semiconductor Corporation, Hsinchu (TW)

(72) Inventor: Chieh-Min Tsai, Pingtung County (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 170 days.

(21) Appl. No.: 15/465,594

(22) Filed: Mar. 21, 2017

(65) Prior Publication Data

US 2017/0374458 A1 Dec. 28, 2017

(30) Foreign Application Priority Data

Jun. 22, 2016 (TW) ..... 105119586 A

(51) Int. Cl.
*H04R 3/02* (2006.01)

(52) U.S. Cl.
CPC ..... *H04R 3/02* (2013.01); *H04R 2430/03* (2013.01); *H04R 2430/25* (2013.01)

(58) Field of Classification Search
CPC ... H04R 3/02; H04R 2430/03; H04R 2430/25
See application file for complete search history.

(56) References Cited

U.S. PATENT DOCUMENTS 5,627,799 A * 5/1997 Hoshuyama ..... H03H 21/0012 367/119
8,249,862 B1 * 8/2012 Cheng ..... G10L 21/0208 381/94.2
9,641,688 B2 * 5/2017 Pandey ..... H04R 3/005
2008/0232607 A1 * 9/2008 Tashev ..... G01S 3/86 381/71.11
2008/0298602 A1 * 12/2008 Wolff ..... H04M 9/082 381/66
2012/0076316 A1 * 3/2012 Zhu ..... H04R 3/005 381/71.11

(Continued)

OTHER PUBLICATIONS

W. Herbordt et al., "GSAEC—Embedding Acoustic Echo Cancellation into the Generalized Sidelobe Canceller," in Proceedings EURASIP European Signal Processing Conference (EUSIPCO), Sep. 4-8, 2000.

(Continued)

*Primary Examiner* — Davetta W Goins
*Assistant Examiner* — Daniel R Sellers
(74) *Attorney, Agent, or Firm* — CKC & Partners Co., LLC

(57) ABSTRACT

A signal processing device includes an acoustic echo cancellation (AEC) circuit, a blocking matrix circuit, a controller, a subtractor, and a filter. The AEC circuit performs an AEC operation based on a far-end signal and a first input signal to generate a processed signal. The blocking matrix circuit suppresses a target signal component of the first input signal and a second input signal, to generate a reference signal. The controller generates a control coefficient based on the processed signal and the second input signal. The subtractor generates an output signal based on the filtered signal and the processed signal. The filter generates the filtered signal in response to the control coefficient, the reference signal, and the output signal.

11 Claims, 4 Drawing Sheets

(56) References Cited

U.S. PATENT DOCUMENTS

2014/0023199 A1* 1/2014 Giesbrecht ..... G10L 21/0216
381/71.1

OTHER PUBLICATIONS

Osamu Hoshuyama et al., "A Robust Adaptive Microphone Array with Improved Spatial Selectivity and Its Evaluation in a Real Environment," in Acoustics, Speech, and Signal Process., Apr. 21-24, 1997, pp. 367-370.
Osamu Hoshuyama et al., "A Real Time Robust Adaptive Microphone Array Controlled by an SNR Estimate," in Acoustics, Speech, and Signal Process., May 15, 1998.
Wolfgang Herbordt et al., "An Acoustic Human-Machine Front-End for Multimedia Applications," EURASIP Journal on Applied Signal Processing, vol. 2003, pp. 21-31, Jan. 2003.
W. Herbordt et al., "Joint Optimization of Lcmv Beamforming and Acoustic Echo Cancellation," in Proceedings of 12th European Signal Processing Conference (EUSIPCO '04), pp. 2003-2006, Sep. 6-10, 2004.

* cited by examiner

SIGNAL PROCESSING DEVICE AND SIGNAL PROCESSING METHOD

CROSS-REFERENCE TO RELATED APPLICATION

This application claims priority to Taiwan Application Serial Number 105119586, filed Jun. 22, 2016, which is herein incorporated by reference.

BACKGROUND

Audio processing devices are widely used in various electronic devices. In some related arts, in the audio processing device, an acoustic echo cancellation (AEC) mechanism is typically configured to process signals prior to a beamforming mechanism.

With such arrangements, in general, the number of circuits in the AEC mechanism will be proportional to the number of microphone. When the number of circuits of the AEC mechanism is too large, overall computation and complexity of the audio processing device are too high. As a result, it is less suitable to be applied in electronic products with low computational capability, e.g., mobile devices.

SUMMARY

In some embodiments, a device is disclosed that includes an acoustic echo cancellation (AEC) circuit, a blocking matrix circuit, a first controller, a subtractor and a filter. The AEC circuit is configured to perform an AEC process based on a far-end signal and a first input signal, to generate a first processed signal. The blocking matrix circuit is configured to suppress a target signal component of the first input signal and a second input signal, to generate a reference signal. The first controller is configured to generate a first control coefficient based on the first processed signal and the second input signal. The subtractor is configured to generate a first output signal based on the first processed signal and a filtered signal. The filter is configured to generate the filtered signal in response to the first control coefficient, the reference signal and the first output signal.

In some embodiments, a device that includes an acoustic echo cancellation (AEC) circuit, a first frequency converter circuit, a second frequency converter circuit, a blocking matrix circuit, a first controller, a subtractor and a filter. The AEC circuit is configured to perform an acoustic echo cancellation process based on a far-end signal and a first input signal, to generate a first processed signal. The first frequency converter circuit is configured to generate the first input frequency domain signal corresponding to the first input signal. The second frequency converter circuit is configured to generate the second input frequency domain signal corresponding to the second input signals. The blocking matrix circuit is configured to generate reference signals based on the first input frequency domain signal and the second input frequency domain signals. The first controller is configured to generate a first control coefficient based on the first processed signal and the second input signal. The subtractor is configured to generate a first output signal based on the first processed signal and a filtered signal. The filter is configured to generate the filtered signal in response to the first control coefficient, the reference signal and the first output signal.

In some embodiments, a method that includes the steps outlined below. An AEC process is performed based on a far-end signal and a first input signal to generate a first processed signal. A target signal component of the first input signal and second input signals are suppressed to generate reference signals. A first control coefficient is generated based on the first processed signal and the second input signals. A first output signal is generated based on the first processed signal and a filtered signal. The filtered signal is generated in response to the first control coefficient, the reference signals and the first output signal.

BRIEF DESCRIPTION OF THE DRAWINGS

This disclosure can be more fully understood by reading the following detailed description of the embodiment, with reference made to the accompanying drawings as follows.

DETAILED DESCRIPTION

The terms "first," "second," etc., may be used herein to describe various elements, these elements should not be limited by these terms. These terms are used to distinguish one element from another.

In addition, as used herein, the terms "coupled," "connected" may refer to two or more elements are in direct physical or electrical contact as, or as an entity or indirect mutual electrical contact, and can also refer to two or more elements or acts interoperability.

Figure 1:
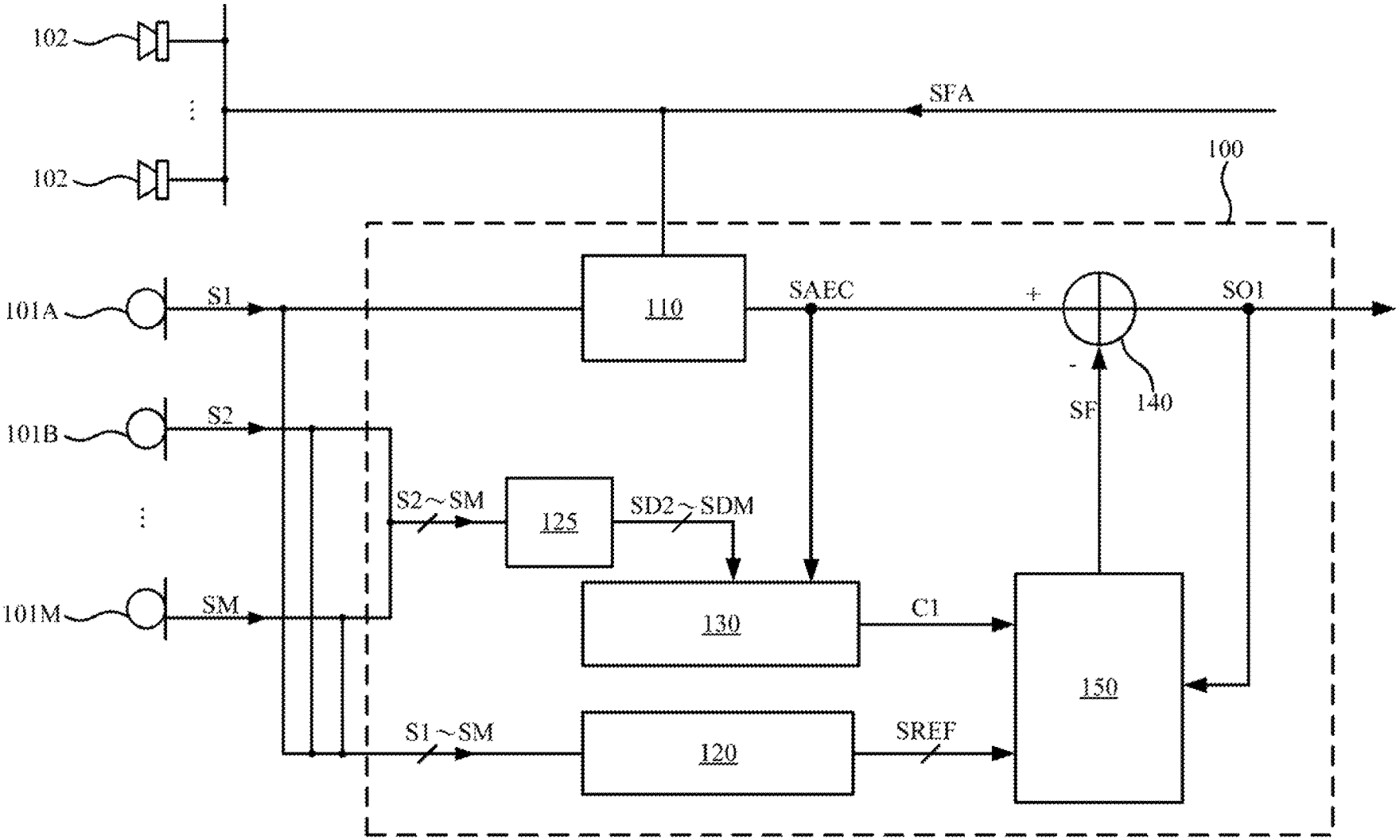
FIG. 1 is a schematic diagram of a signal processing device in accordance with some embodiments of the present disclosure.

Reference is now made to FIG. 1. FIG. 1 is a schematic diagram of a signal processing device 100 in accordance with some embodiments of the present disclosure. The signal processing device 100 includes an acoustic echo cancellation (AEC) circuit 110, a blocking matrix circuit 120, a controller 130, a subtractor 140, and a filter 150.

The AEC circuit 110 is configured to perform an AEC process based on the input signal S1 and a far-end signal SFA, to generate a processed signal SAEC. As illustratively shown in FIG. 1, in some embodiments, the AEC circuit 110 is coupled to a microphone 101A of microphones 101A-101M, and an input signal S1 is an audio signal received by the microphone 101A. In some other embodiments, the input signal S1, which is received by the AEC circuit 110, can also be replaced with an audio signal outputted from a fixed beamforming circuit based on input signals S1-SM received from the microphones 101A-101M. In some embodiments, the far-end signal SFA is an audio signal expected to be outputted by at least one of speakers 102.

The blocking matrix circuit 120 is coupled to the microphones 101A-101M to receive the corresponding input signals S1-SM. The blocking matrix circuit 120 is configured to suppress target signal components of the input signals S1-SM to generate reference signals SREF. In some embodiments, the target signal components are major power signals that are expected to be received by the microphones 101A-101M, for example, the speaker's voice. In some embodiments, the blocking matrix circuit 120 can be implemented by M adaptive filters. In some embodiments, the blocking matrix circuit 120 generates M−1 reference signals. For example, when M is 2, the blocking matrix circuit 120 can subtract one of the input signals S1 and S2 from another one of the input signals S1 and S2 to obtain the reference signal SREF.

The implementations of the blocking matrix circuit 120 illustrated above are given for illustrative purposes. Various implementations to implement the above functions of the blocking matrix circuit 120 are within the contemplated scope of the present disclosure.

In some embodiments, the audio processing device 100 further includes a delay time circuit 125. The delay time circuit 125 is coupled to the microphones 101B-101M, and is configured to delay the input signals S2-SM for a predetermined time to generate delayed input signals SD2-SDM. In some embodiments, the predetermined time mentioned above is corresponding to the operating time of the AEC circuit 110. With such arrangements, the delayed input signals SD2-SDM can be synchronized with the processed signal SAEC.

The controller 130 is configured to generate control coefficient C1 based on the processed signal SAEC and the input signals S2-SM. In some embodiments, the controller 130 is configured to estimate a direction corresponding to the target signal components based on the processed signal SAEC and one of the delayed input signals SD2-SDM.

For example, the controller 130 can employ a direction of arrival (DOA) estimation to estimate the direction. In some embodiments, the controller 130 can perform a generalized cross correlation (GCC) calculation on the processed signal SAEC and one of the delayed input signals SD2-SDM, in order to estimate the direction of the target signal components and to generate control coefficient C1 accordingly. For example, in some embodiments, the above described operating method of control coefficient C1 can be expressed as follows:

$$C1 = \begin{cases} 0, & THL < \tau' < THH,\ \tau' = \underset{\tau}{\operatorname{argmax}}(Corr),\ Corr = GCC\{SAEC, SD2, \tau\} \\ 1, & \text{others} \end{cases}$$

where, THL is a predetermined low threshold, THH is a predetermined high threshold, τ' denotes a delay sample, which can be used to calculate the direction, of the target signal components, and GCC denotes the generalized cross correlation (GCC) calculation, which is shown to delay the input signal SD2 as an example.

The above arrangements of the controller 130 are given for illustrative purpose. Various types of the controller 130 are within the contemplated scope of the present disclosure.

The subtractor 140 is coupled to the AEC circuit 110 and the filter 150, to receive the processed signal SAEC and a filtered signal SF respectively. The subtractor 140 is configured to subtract the filtered signal SF from the processed signal SAEC, to generate an output signal SO1.

The filter 150 is coupled to the controller 130, the blocking matrix circuit 120 and the subtractor 140, to receive the control coefficient C1, the reference signal SREF and the output signal SO1 respectively. The filter 150 is configured to generate the filtered signal SF in response to the control coefficient C1, the reference signal SREF and the output signal SO1. In some embodiments, the filter 150 can be implemented by an adaptive filter, and can control whether to adjust weighting coefficients of taps within the filter 150 in accordance with the control coefficient C1. In some embodiments, the filter 150 is configured to output the filtered signal SF based on the control coefficient C1, one or more reference signals SREF and the output signal SO1, in order to reduce the interference components of the output signal 501.

With such arrangements, the signal processing device 100 can reduce the echo and the interference components of the output signal SO1 only under the operation of the single AEC circuit 110. As a result, compared to the related art discussed above, the amount of the computation and the complexity of the signal processing device 100 can be reduced obviously.

Figure 2:
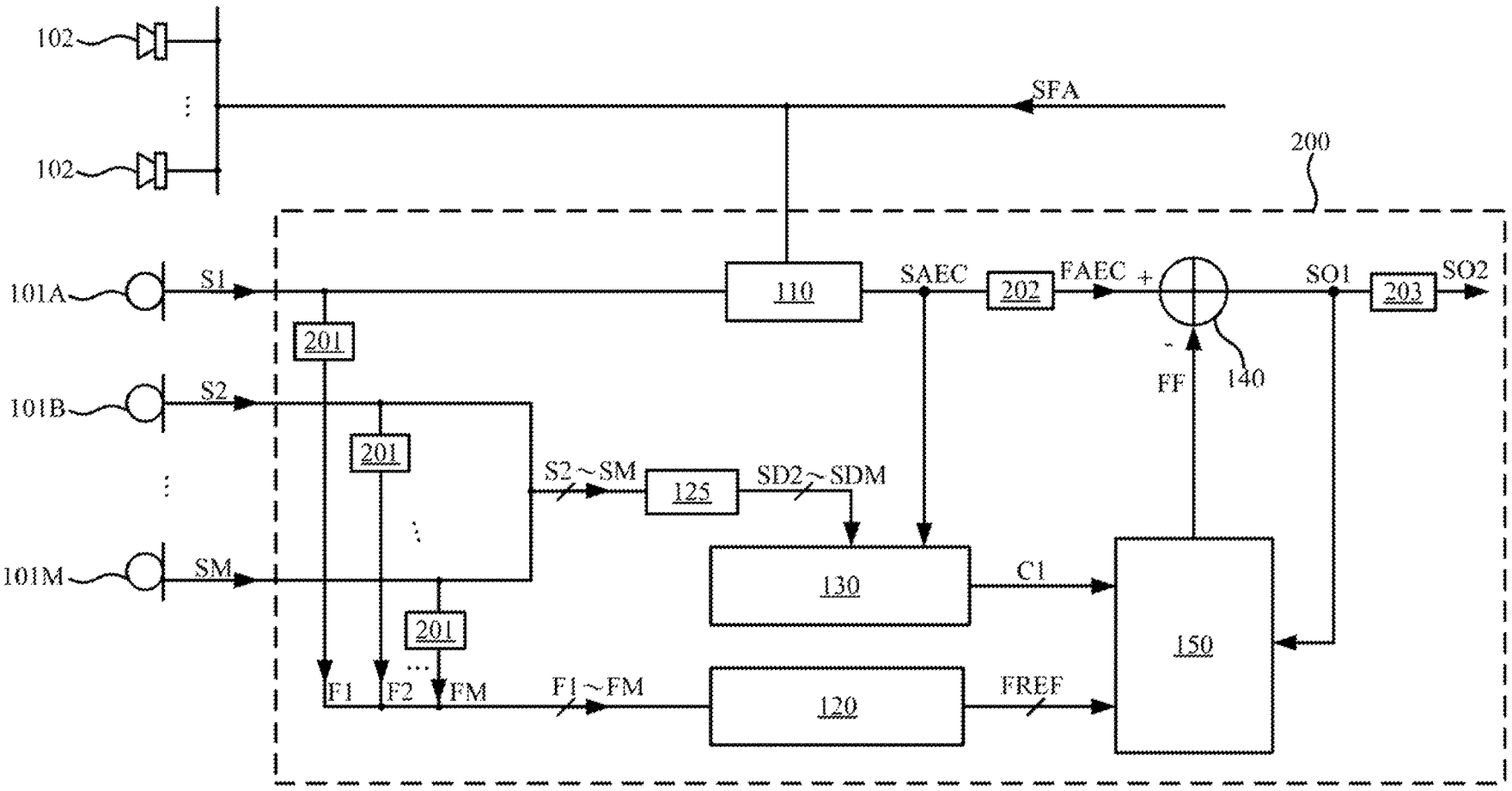
FIG. 2 is a schematic diagram of a signal processing device in accordance with some embodiments of the present disclosure.

The signal processing device 100 in FIG. 1 is implemented by circuit operations in the time domain, but the present disclosure is not limited thereto. In some other embodiments, the signal processing device 100 can also be implemented by circuit operations in the frequency domain. Reference is made to FIG. 2. FIG. 2 is a schematic diagram of a signal processing device 200 in accordance with some embodiments of the present disclosure. With respect to FIG. 1, like elements in FIG. 2 are designated with the same reference numbers for ease of understanding.

Compared to the signal processing device 100 in FIG. 1, the signal processing device 200 further includes frequency converter circuits 201, a frequency converter circuit 202 and an inverse frequency converter circuit 203. The frequency converter circuits 201 are respectively coupled to microphones 101A-101M to receive input signals S1-SM respectively. The frequency converter circuits 201 generate the corresponding input frequency-domain signals F1-FM based on the input signals S1-SM. For example, the frequency converter circuit 201, which is coupled to the microphone 101A, can perform a fast Fourier transform on the input signal S1 to convert the input signal S1 in the time domain to the corresponding input frequency domain signal F1 in the frequency domain. The arrangements of the frequency conversion shown above are given for illustrative purposes. Various arrangements of the frequency conversion are within the contemplated scope of the present disclosure.

In this example, the blocking matrix circuit 120 is further configured to generate reference signals FREF based on the input frequency domain signals F1-FM. The frequency converter circuit 202 is coupled to the AEC circuit 110 to receive the processed signal SAEC. The frequency converter circuit 202 is configured to generate a corresponding processed frequency signal FAEC based on the processed signal SAEC. In this example, the subtractor 140 is further configured to subtract a filtered signal FF from the processed frequency signal FAEC to generate the output signal SO1.

The inverse frequency converter circuit 203 is coupled to the subtractor 140 to receive the output signal SO1. The inverse frequency converter circuit 203 is configured to generate a corresponding output signal SO2 in response to the output signal SO1. In this example, the output signal SO1 is in the frequency domain. In some embodiments, the inverse frequency converter circuit 203 is configured to convert the output signal SO1 in the frequency domain to the corresponding output signal SO2 in the time domain. In some embodiments, the inverse frequency converter circuit 203 is configured to perform an inverse fast Fourier transform on the output signal SO1 to generate the output signal SO2. The arrangements of the inverse frequency conversion are given for illustrative purposes. Various arrangements of the inverse frequency conversion are within the contemplated scope of the present disclosure.

Figure 3:
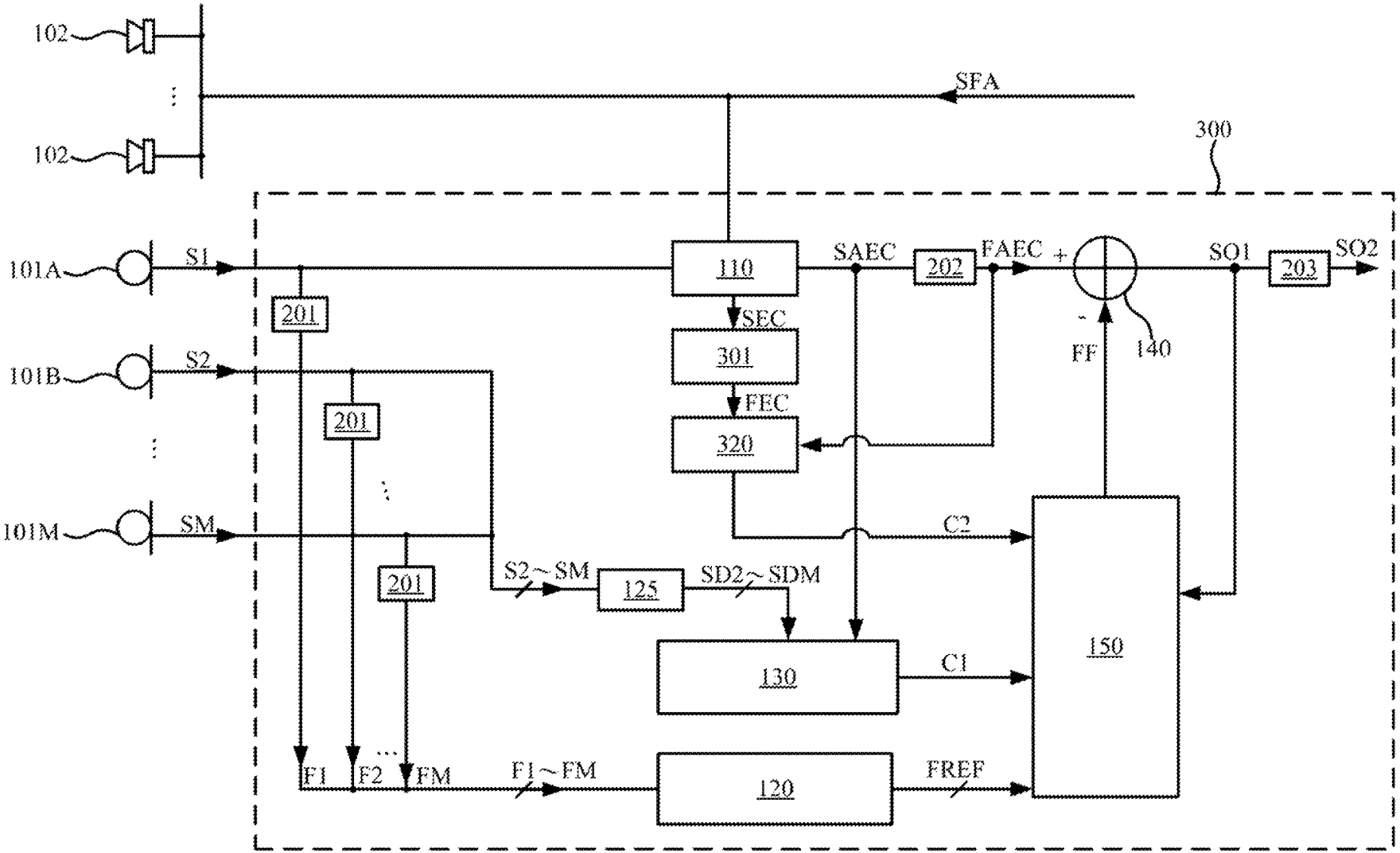
FIG. 3 is a schematic diagram of a signal processing device in accordance with some embodiments of the present disclosure.

Reference is now made to FIG. 3. FIG. 3 is a schematic diagram of a signal processing device 300 in accordance with some embodiments of the present disclosure. With respect to the embodiments of FIG. 2, like elements in FIG. 3 are designated with the same reference numbers for ease of understanding.

Compared to the signal processing device 200 in FIG. 2, the signal processing device 300 further includes a frequency converter circuit 301 and a controller 320. In some embodiments, the AEC circuit 110 is further configured to generate a predicted acoustic echo signal SEC based on the far-end signal SFA and the input signal S1. In some embodiments, the predicted acoustic echo signal SEC is configured to indicate a predicted energy of the acoustic echo. In this example, the frequency converter circuit 301 is configured to perform the frequency conversion on the predicted acoustic echo signal SEC to generate a corresponding processed frequency signal FEC. The controller 320 is configured to generate a control coefficient C2 based on the processed frequency signal FEC and the processed frequency signal FAEC. In some embodiments, the controller 320 is configured to determine whether the interference exists in the subband. For illustration, the controller 320 can perform calculations defined by the following equations to generate a control coefficient C2.

$$C2(K) = \begin{cases} 1, & SER_K > TH1_K, SER_{SPEECH} > TH2 \\ 0, & \text{others} \end{cases},$$

where K=1-M and M is the length of the subband, $TH1_K$ and TH2 are the predetermined thresholds, and $SER_K$ is the ratio of a first value and a second value. In some embodiments, the first value is a smoothed amplitude corresponding to the Kth subband of the processed frequency signal FAEC, and the second value is the smoothed amplitude corresponding to the Kth subband of the processed frequency signal FEC; $SER_{SPEECH}$ is the ratio of a third value and a fourth value, in which the third value is a summation of the smoothed amplitudes corresponding to the subbands of a predetermined bandwidth of the processed frequency signal FAEC, and the fourth value is the summation of the smoothed amplitudes corresponding to the subbands of a predetermined bandwidth of the processed frequency signal FEC. In some embodiments, the predetermined bandwidth is a voice frequency band, e.g., approximately 500-3000 Hz.

In some embodiments, the filter 150 is further configured to generate the filtered signal FF in response to the control coefficient C1, the control coefficient C2, the reference signals FREF and the output signal SO1. For example, in the embodiments in FIG. 3, the filter 150 further updates the weighting coefficients of taps in the filter 150 in a condition that the control coefficient C1 and the control coefficient C2 are both equal to 1. As previously described, the filter 150 is configured to reduce the interference components of the output signal SO1. With the above arrangements, the controller 320 can distinguish between the influences of echo and interference for each subband, and update the control coefficient C2 when the interference has higher signal components in the output signal SO1. As a result, the influence of echo remaining in the system on the filter 150 can be reduced, and thus the filter 150 is prevented from adjusting the weighting coefficients a wrong direction.

The above arrangements of the controller 320 are given for illustrative purpose. Various types of the controller 320 are within the contemplated scope of the present disclosure. In some other embodiments, the frequency converter circuit 301 and the controller 320 may be built in the AEC circuit 110. In some embodiments, the predicted acoustic echo signal SEC may also be replaced with various kinds of computational information generated by the AEC circuit 110.

Figure 4:
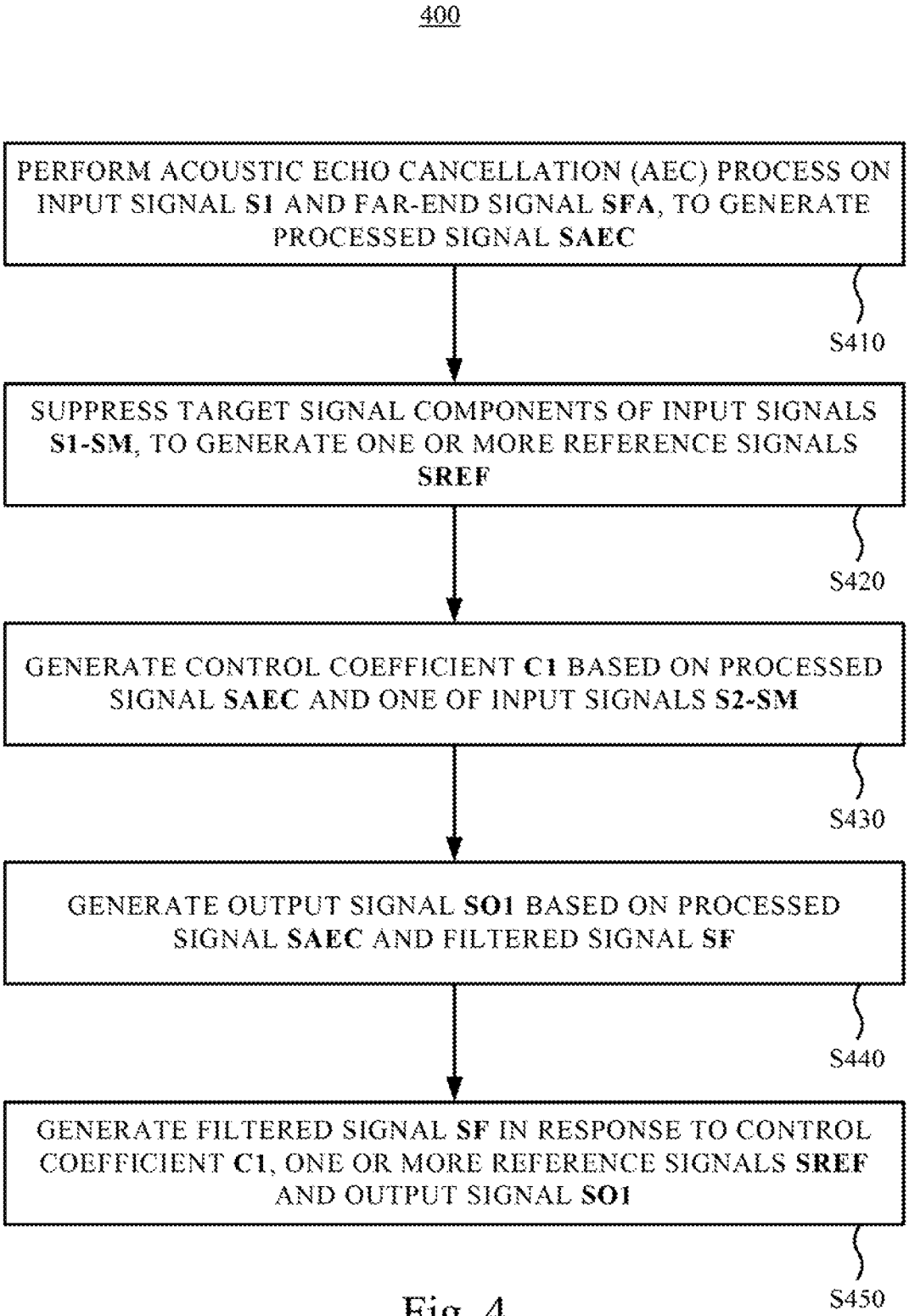
FIG. 4 is a flow chart of a method illustrating the signal processing device in accordance with some embodiments of the present disclosure.

FIG. 4 is a flow chart of a signal processing method, in accordance with some embodiments of the present disclosure. In some embodiments, the signal processing method 400 includes operations S410, S420, S430, S440 and S450.

In operation S410, the AEC process is performed on the input signal S1 and the far-end signal SFA to generate the processed signal SAEC. For illustration, as shown in FIG. 1, the AEC circuit 110 can perform AEC process based on the far-end signal SFA and the input signal S1 received by the single microphone 101A to generate the processed signal SAEC.

In operation S420, the target signal components of the input signals S1-SM are suppressed to generate one or more reference signals SREF. For illustration, as shown in FIG. 1, the reference signals SREF can be generated by the blocking matrix circuit 120 in response to the input signals S1-SM. In some embodiments, the blocking matrix circuit 120 generates M−1 reference signals. For example, when M is 2, the blocking matrix circuit 120 can obtain the reference signal SREF from the subtraction of input signal S1 and input signal S2.

In operation S430, the control coefficient C1 is generated based on the processed signal SAEC and one of the input signals S1-SM. For illustration, as shown in FIG. 1, the controller 130 can perform the generalized cross correlation calculation based on the processed signal SAEC and one of the input signals S1-SM to generate the control coefficient C1.

In operation S440, the output signal SO1 is generated based on the processed signal SAEC and the filtered signal SF.

In operation S450, the filtered signal SF is generated in response to the control coefficient C1, one or more reference signals SREF and the output signal SO1. For illustration, as shown in FIG. 1, the filter 150 can control whether to adjust the weighting coefficients of the filter 150 in accordance with the control coefficient C1 and output different filtered signal SF in response to the reference signals SREF and the output signal SO1.

The operations of the signal processing method 400 are given for illustrative purposes and are not necessarily performed in the order shown. Alternatively stated, operations may be added, replaced, changed order, and/or eliminated as appropriate, in accordance with the spirit and scope of various embodiments of the present disclosure.

In summary, the signal processing device and the signal processing method are able to reduce the echo and the interference components of the output signal with operations of a single AEC circuit. As a result, the amount of the computation and the complexity of the signal processing device can be reduced efficiently.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A signal processing device, comprising:

an acoustic echo cancellation (AEC) circuit configured to perform an acoustic echo cancellation process based on a far-end signal and a first input signal, to generate a first processed signal, and configured to generate a predicted acoustic echo signal based on the far-end signal and the first input signal;

a plurality of frequency converter circuits configured to generate a first input frequency domain signal corresponding to the first input signal, a second input frequency domain signal corresponding to a second input signal, a first processed frequency signal corresponding to the first processed signal, and a second processed frequency signal corresponding to the predicted acoustic echo signal, respectively;

a blocking matrix circuit configured to generate a reference signal based on the first input frequency domain signal and the second input frequency domain signal;

a first controller circuit configured to generate a first control coefficient based on the first processed signal and the second input signal;

a subtractor circuit configured to determine a difference between the first processed signal and a filtered signal, in order to generate a first output signal;

a second controller circuit configured to generate a second control coefficient based on the first processed frequency signal and the second processed frequency signal; and a filter configured to generate the filtered signal in response to the first control coefficient, the second control coefficient, the reference signal, and the first output signal.

2. The signal processing device of claim 1, wherein the subtractor circuit is further configured to subtract the filtered signal from the first processed frequency signal, to generate the first output signal, and the signal processing device further comprises:

an inverse frequency converter circuit configured to generate a second output signal corresponding to the first output signal.

3. The signal processing device of claim 1, wherein the second controller circuit is configured to determine whether a signal component corresponding to interference exists based on the first processed frequency signal and the second processed frequency signal, and to update the second control coefficient in a condition that the signal component exists.

4. The signal processing device of claim 1, wherein one of the frequency converter circuits is configured to perform a Fourier transform on the second input signal, to generate the second input frequency domain signal.

5. A signal processing method, comprising:

performing an acoustic echo cancellation (AEC) process based on a far-end signal and a first input signal, to generate a first processed signal and generating a predicted acoustic echo signal based on the far-end signal and the first input signal;

generating a first input frequency domain signal corresponding to the first input signal, a second input frequency domain signal corresponding to a second input signal, a first processed frequency signal corresponding to the first processed signal, and a second processed frequency signal corresponding to the predicted acoustic echo signal;

generate a reference signal based on the first input frequency domain signal and the second input frequency domain signal;

generating a first control coefficient based on the first processed signal and the second input signal;

determining a difference between the first processed signal and a filtered signal, in order to generate a first output signal;

generating a second control coefficient based on the first processed frequency signal and the second processed frequency signal; and generating the filtered signal in response to the first control coefficient, the second control coefficient, the reference signal, and the first output signal.

6. The signal processing method of claim 5, further comprising:

delaying the second input signal for a predetermined time to generate a delayed input signal, wherein the predetermined time corresponds to an operating time for performing the AEC process.

7. The signal processing method of claim 6, wherein the step of generating the first control coefficient further comprises:

estimating a direction corresponding to a target signal component of the first input signal and the second input signal according to the first processed signal and the delayed input signal, and generating the first control coefficient according to the direction.

8. The signal processing method of claim 7, wherein the step of estimating the direction comprises:

performing a generalized cross-correlation calculation based on the first processed signal and the delayed input signal, to estimate the direction.

9. The signal processing method of claim 5, wherein the step of generating the first input frequency domain signal, the second input frequency domain signal, the first processed frequency signal, and the second processed frequency signal comprises:

performing a Fast Fourier transform on a corresponding one of the first input signal, the second input signal, the first processed signal, and the predicted acoustic echo signal, in order to generate a corresponding one of the first input frequency domain signal, the second input frequency domain signal, the first processed frequency signal, and the second processed frequency signal.

10. The signal processing method of claim 5, wherein the first output signal is further configured to be generated by subtracting the filtered signal from the first processed frequency signal, and the signal processing method further comprises:

performing an inverse frequency conversion on the first output signal, to generate a second output signal.

11. The signal processing method of claim 5, wherein the step of generating the second control coefficient comprises:

determining whether a signal component corresponding to interference exists based on the first processed frequency signal and the second processed frequency signal, and updating the second control coefficient in a condition that the signal component exists.

* * * * *